US008740576B2

(12) United States Patent
Konnur

(10) Patent No.: US 8,740,576 B2
(45) Date of Patent: Jun. 3, 2014

(54) PUMPING SYSTEM FOR PUMPING LIQUID FROM A LOWER LEVEL TO AN OPERATIVELY HIGHER LEVEL

(75) Inventor: Madhav Shrinivas Konnur, Gujarat (IN)

(73) Assignee: Rahul Nanubhai Amin, Gujarat (IN)

( * ) Notice: Subject to any disclaimer, the term of this patent is extended or adjusted under 35 U.S.C. 154(b) by 585 days.

(21) Appl. No.: 12/671,764

(22) PCT Filed: Sep. 18, 2008

(86) PCT No.: PCT/IN2008/000596
§ 371 (c)(1),
(2), (4) Date: Feb. 2, 2010

(87) PCT Pub. No.: WO2009/063501
PCT Pub. Date: May 22, 2009

(65) Prior Publication Data

US 2011/0229345 A1 Sep. 22, 2011

(30) Foreign Application Priority Data

Sep. 20, 2007 (IN) ..... 1830/MUM/2007

(51) Int. Cl.
*F04F 10/00* (2006.01)
*F04D 9/00* (2006.01)
*F04B 23/08* (2006.01)

(52) U.S. Cl.
CPC ..... *F04F 10/00* (2013.01); *F04D 9/007* (2013.01)
USPC ..... 417/200; 417/199.2; 417/53; 137/143

(58) Field of Classification Search
CPC ..... F04D 9/007; F04D 9/041; F04D 9/008; F04F 10/00; F04F 10/02; E02B 7/18
USPC ..... 417/279, 53, 200, 199.2; 137/123, 143, 137/205
See application file for complete search history.

(56) References Cited

U.S. PATENT DOCUMENTS 1,472,428 A * 10/1923 Case et al. ..... 137/147
1,770,340 A * 7/1930 Lawaczeck ..... 405/108
(Continued)

FOREIGN PATENT DOCUMENTS

GB 2208398 A 3/1989

OTHER PUBLICATIONS

References were cited in the International Search Report of PCT/IN2008/000596 Jun. 26, 2009.

*Primary Examiner* — Charles Freay
*Assistant Examiner* — Alexander Comley
(74) *Attorney, Agent, or Firm* — Cowan, Liebowitz & Latman, P.C.; Mark Montague

(57) ABSTRACT

A pumping system and a method for pumping liquid from a lower level to an operatively higher level are disclosed. The pumping system includes a pumping device, a bent delivery conduit, a single control port opening and control elements. The conduit has an operatively inclined ascending conduit section; an operatively inclined descending conduit section and an operatively horizontal peak section between the inclined sections; one end of the ascending conduit fitted to the outlet of the pumping device and one end of the descending conduit being below liquid level of the higher level. The single port opening is provided at the junction between the horizontal peak section and the descending conduit section, and spaced apart from the ascending conduit junction. The control elements introduce pressurized air into and evacuate air from the delivery conduit through the single port opening.

5 Claims, 16 Drawing Sheets

(56) References Cited

U.S. PATENT DOCUMENTS

| | | | | | |
|---|---|---|---|---|---|
| 2,171,579 | A | * | 9/1939 | Loughridge | 137/126 |
| 2,745,426 | A | * | 5/1956 | Ponsar | 137/143 |
| 3,374,801 | A | * | 3/1968 | Rander | 137/143 |
| 3,575,004 | A | * | 4/1971 | Gachne et al. | 405/108 |
| 3,776,439 | A | * | 12/1973 | Settle | 266/237 |
| 4,064,047 | A | * | 12/1977 | Bernreiter et al. | 210/96.1 |
| 4,112,963 | A | * | 9/1978 | Brubaker | 137/148 |
| 4,303,092 | A | * | 12/1981 | Logan | 137/142 |
| 4,311,410 | A | * | 1/1982 | Gutierrez Atencio | 405/78 |
| 4,364,228 | A | * | 12/1982 | Eller | 60/398 |
| 4,508,136 | A | * | 4/1985 | Kah, Jr. | 137/218 |
| 5,199,455 | A | * | 4/1993 | Dlouhy | 137/217 |
| 5,358,000 | A | * | 10/1994 | O'Hair | 137/124 |
| 5,898,375 | A | * | 4/1999 | Patterson | 340/612 |
| 5,970,999 | A | * | 10/1999 | Greenia | 137/1 |
| 6,079,953 | A | * | 6/2000 | Morales | 417/53 |
| 6,443,181 | B1 | | 9/2002 | Powell | |
| 6,742,534 | B2 | * | 6/2004 | Hogsden et al. | 137/12 |
| 6,792,962 | B1 | | 9/2004 | Smith | |
| 7,059,341 | B2 | * | 6/2006 | Kumar et al. | 137/143 |
| 7,874,809 | B2 | * | 1/2011 | Kamata et al. | 417/38 |
| 2005/0058511 | A1 | * | 3/2005 | Kumar et al. | 405/39 |
| 2007/0122290 | A1 | * | 5/2007 | Kamata et al. | 417/44.2 |
| 2008/0178378 | A1 | * | 7/2008 | Godfrey et al. | 4/459 |
| 2009/0020163 | A1 | * | 1/2009 | Colton et al. | 137/218 |

* cited by examiner

PUMPING SYSTEM FOR PUMPING LIQUID FROM A LOWER LEVEL TO AN OPERATIVELY HIGHER LEVEL

FIELD OF THE INVENTION

This invention relates to a system for pumping water from a lower level to a relatively higher level, for further distribution and or consumption.

BACKGROUND

Liquids are pumped over long distance for storage and consumption. Water supplied to residents of a city is pumped from sources like lake and or rivers located far away from the city. Invariably catchment areas are located at a level lower than the consumption points. In a pumping station located close to the catchment area pumps are used to pump water over a terrain having many high and low regions. Once the flow is established, the conveying conduit and the pump casing are filled with water and water from a low lying catchment area is transferred to a storage reservoir or tank at a higher level, near the point of consumption. When the pumping unit is switched off water contained in the conduit line flows back due to gravity into the low level reservoir. This flow back establishes a siphon to drain the water from the high level tank back to the low level reservoir.

A siphon is a continuous tube that allows liquid to be drained from a reservoir through an intermediate point that is higher than the liquid level of the reservoir to a lower level. Flow of liquid in a siphon is driven by the difference in hydrostatic pressure without any need for pumping. It is necessary that the outlet end of the tube be lower than the liquid surface in the reservoir.

Liquids rise over the crest of a siphon as they are pushed by atmospheric pressure. A tube at the starting stage of a siphon is filled with liquid and atmospheric pressure acts on both ends of the conduit. The longer leg of the tube carries a greater weight of liquid. Gravity then drains the liquid through the longer leg, and this creates a low pressure inside the tube and at the other end of the tube and the liquid starts to flow into the tube establishing a siphon. Once started, a siphon requires no additional energy to keep the liquid flowing up and out of the reservoir. The siphon will pull the liquid out of the reservoir until the level falls below the intake causing air to enter the tube (cavitation/evolving of air dissolved in water) or until the outlet level of the siphon equals the level of the reservoir, whichever happens first. Capillary action can enhance the siphon and cavitation may modify the phenomenon and cause the siphon to break.

Cavitation is defined as the phenomenon of formation of vapour bubbles of a flowing liquid in a region where the pressure of the liquid falls below its vapour pressure. Cavitation often occurs in pumps, propellers and impellers.

The maximum height of the siphon crest is limited by atmospheric pressure, the density of the liquid, and its vapour pressure. When the pressure exerted by the weight of the liquid equals that of atmospheric pressure, a vacuum will form at the high point and the siphon effect will end. The liquid may boil briefly until the vacuum is filled with the liquid's vapour pressure. For water at standard atmospheric pressure, the maximum siphon height is approximately 10 m (33 feet) and for mercury it is 76 cm (30 inches).

In a conventional pumping system, non return and butterfly valves are required to arrest the reverse flow of liquid. Presence of valves and non return valves create resistance in forward flow of water and result in hydraulic losses and increases pumping cost.

Another problem encountered in large pumping system is trapped volume of gas, usually air, at the start of pumping. As there are many high and low regions in the lay out of the delivery conduit depending on the terrain, many air pockets are created at intermediate high regions within the conduit. These compressed air pockets and change in direction of water flow creates water hammer and surge creating high stresses and consequent damages. Surge conditions may occur for various reasons like pump start/stop sequences, power supply failure, and valve failure in the liquid system. Also change in demand and rapid valve operations causes surge conditions leading to water hammer.

Existing Knowledge:

Some of the devices used for prevention of back flow due to siphon effect are described herein under:

U.S. Pat. No. 6,443,181 discloses a "Backflow prevention apparatus", consisting of a valve with a valve seat, a pivoted closing device coupled to the valve seat provided with a seal having a closure mechanism operated by a linkage mechanism. This device is not suitable for large pumping system as the presence of the valves and non return valves create resistance in forward flow of water and result in hydraulic losses and increases pumping cost.

U.S. Pat. No. 6,742,534 discloses a "Method of damping surges in a liquid system" This system includes a surge vessel in which air is trapped and in the event of a surge in the system, the volume of trapped air within the surge vessel is changed to dampen the surge by providing pressure sensors and a control apparatus for operating a compressor, air inlet valve or air relief valve to maintain constant the mass of the trapped air in the surge vessel is maintained constant, irrespective of the liquid level within the surge vessel. The method as disclosed in this document is not suitable for preventing back flow of liquid due to siphon effect from a higher level tank or reservoir to a lower level liquid source.

U.S. Pat. No. 6,792,962 discloses an "Enhanced backflow prevention apparatus and method". This device is a plunger operated anti-siphoning device for use in a irrigation sprinkler system. The plunger is generally annular in shape and blocks water flow from the outlet channel into the inlet channel but allows flow from the inlet channel to the outlet channel. When the inlet channel is closed, the plunger permits air to flow into the outlet through the cap. This device is not suitable for large pumping system as the presence of the valves and non return valves create resistance in forward flow of water and result in hydraulic losses and increases pumping cost.

Hence there is a need for system for pumping water from a source at a relatively lower level to a reservoir at a relatively higher level and prevent back flow of liquid do to siphoning.

OBJECTS OF THE INVENTION

One of the objects of this invention is to devise a system for pumping a liquid from a relatively lower level to a higher level with out the use of return valves and butterfly valves.

Another object of this invention is to provide a system which reduces occurrence of water hammer and surge in the system.

Yet another object of this invention is to provide a system which reduces the power consumption of the pump.

Yet another object of this invention is to provide a system wherein instantaneous starting and stopping of the pump is possible with out any need for valve operations.

Another object of this invention is to provide a system that is suitable for installation wherein the liquid source and liquid delivery points are located far away from one other.

Yet another object of this invention is to provide a system that does not require manual supervision or intervention to start, run and stop the pump operation.

SUMMARY OF THE INVENTION

In accordance with this invention there is provided a pumping system for pumping liquid from a lower level to an operatively higher level; said pumping system comprising:

(i) pumping device fitted at the lower level;

(ii) a bent delivery conduit; said conduit having an operatively inclined ascending conduit section; an operatively inclined descending conduit section and an operatively horizontal peak section between said inclined sections; one end of said ascending conduit fitted to the outlet of said pumping device and one end of said descending conduit being below liquid level of said higher level; a junction being defined between said horizontal peak section and said descending conduit section;

(iii) a port opening provided at the peak section spaced apart from said junction; and (iv) control means adapted to introduce pressurized air into and evacuate air from said delivery conduit through said port.

Typically the control means comprises vacuum pump, air compressor, solenoid operated valves, motor-operated valve, level switches and a programmable controller.

Typically the angle of inclination of said inclined conduits is in the range of 40 to 45 degrees with reference to a horizontal peak section.

Typically the control means is provided with a power backup unit.

In accordance with this invention there is provided a method of pumping liquid from a lower level to an operatively higher level, said method comprising the steps:

(a) providing a pumping device fitted at the lower level;

(b) providing a bent delivery conduit having an operatively inclined ascending conduit section, an operatively inclined descending conduit section and an operatively horizontal peak section between the inclined sections; fitting one end of the ascending conduit section to the outlet of the pumping device and having the open end of the descending conduit dipped below liquid level of said higher level;

(c) providing a port opening at the junction defined between the horizontal peak section and the descending conduit section, spaced apart from said junction;

(d) providing control means activated at start of pumping operation to introduce pressurized air into and evacuate air from the delivery conduit through the port;

(e) providing a standby power backup system for supplying electrical power to the control system;

(f) pumping liquid from the lower level to the operatively higher level via the delivery conduit;

(g) evacuating air pocket formed in the delivery conduit, via the port provided at the peak location to reduce head difference between the liquid at the lower level and higher level; and (h) in case of failure of power supply to the pumping device or at the end of pumping cycle, breaking the reverse flow of water from the higher level to the lower level due to siphon action by admitting compressed air at the peak location via said port.

This invention envisages a system which eliminates the conventional non return and butterfly valve, thus eliminating the investment cost as well as the running equivalent power cost due to hydraulic losses induced because of the presence of valves in the conventional delivery system. Envisaged in accordance with this invention is a system in which the reverse flow is arrested by breaking of siphon. What is envisaged in accordance with this invention is an efficient combination of siphon, pump and "Vacuum/Siphon breaking" through a single port for energy conservation in pumping plants.

In any pumping system where the water is pumped from a low level to a higher level siphon effect is used to reduce the total pump head.

The total head of the pump before siphon effect takes place is $$TH^1 = Z^1 + h_{f1} + V_c^2/2\,g$$

Where, $Z^1$=difference in height between water level of the supply source and the weir crest flow level of the peak location.

$h_{f1}$=friction and minor losses in the conduit from the pump outlet to the peak location.

$V_c^2/2\,g$=velocity head at peak location weir crest.

The moment the pump is started water starts flowing from the pump outlet and then starts going up the inclined conduit section leading to the peak location. As the water level builds up in the inclined conduit section the load on the pump increases till it reaches the peak location. Once the downward flow starts in the declining section of the conduit, gravitational force acting upon the mass of water in the downward sloping conduit creates a low pressure at the peak location reducing the effective head load of the pump. This reduction in pump head is due to the siphon effect created by the downward sloping conduit.

Effective head after the siphon effect takes place is $$TH = Z + h^f$$

Where,

Z=elevation difference between low water level in the source and high water level in the storage facility.

$h_f$=friction and minor losses from the pump outlet to delivery outlet.

Therefore reduction in pump head is $$TH^1 - TH = (Z^1 + h_{f1} + V_c^2/2g) - (z + h_f)$$
$$= (Z^1 - Z) + (h_{f1} - h_f) + V_c^2/2g$$

Further, the siphon system in accordance with this invention is equipped with a control means to selectively withdraw/Inject air from the delivery conduit used in the pumping system for starting/stopping of siphoning effect.

The siphon system in accordance with this invention operates with reduction in the value of the operating head of the pump by eliminating the valve losses as no valves are needed in this system at the delivery outlet and there is reduced static head, in-turn leading to energy saving. The control system enables operation of the siphon and pump combined system using a single port for air injection or evacuation of air from the delivery conduit.

The system enables vacuum generation by vacuum pumping or air injection through the same port (located appropriately in the delivery conduit) in case of starting and stopping of pump respectively. Only one port is used for siphon operation for starting/stopping. Location of the port is at the terminal end on the flat section of the delivery conduit, towards down leg portion to enable both vacuum/pressure injection by pneumatically/hydraulically operated circuit through a control gear scheme comprising solenoids/valves and other auxiliaries. Back up power supply is essential for the system auxiliaries in the event of grid failure.

The phenomenon of siphon breaking can be by injection of air from the atmosphere itself, however in accordance with a preferred embodiment of the invention for control and for quick timing compressed air injection, typically of the level of 3 to 6 bar, is used to control and accelerate the siphon breaking event.

Level sensing device generate signals to operate either the vacuum pump or the accumulator of the compressor to release air in to the conduit to initiate/break the siphon depending on whether the pump is started or stopped. This system gets activated for injection of compressed air in the event of power failure from grid supply. A sensing device for the grid power failure {with suitable±time limits) and signaling element is also included in the system.

One of the pre-requisites of the back flow siphon is that the outlet portion of delivery line has to be in fully submerged condition at least to a level of greater than the diameter of the conduit.

This application also eliminates the need for delivery throttling valve and non return valve as the pump can be operated with delivery line fully open.

Each pump and motor set will have a set of auxiliary devices for vacuum/siphon breaking arrangement to enable individual set start/stop operational sequence as required.

BRIEF DESCRIPTION OF THE DRAWINGS

The invention will now be described with reference to the accompanying drawings, in which all the aspects and advantages of the invention will become apparent with the description of the preferred, non-limiting embodiment, in which.

DETAILED DESCRIPTION

Figure 1:
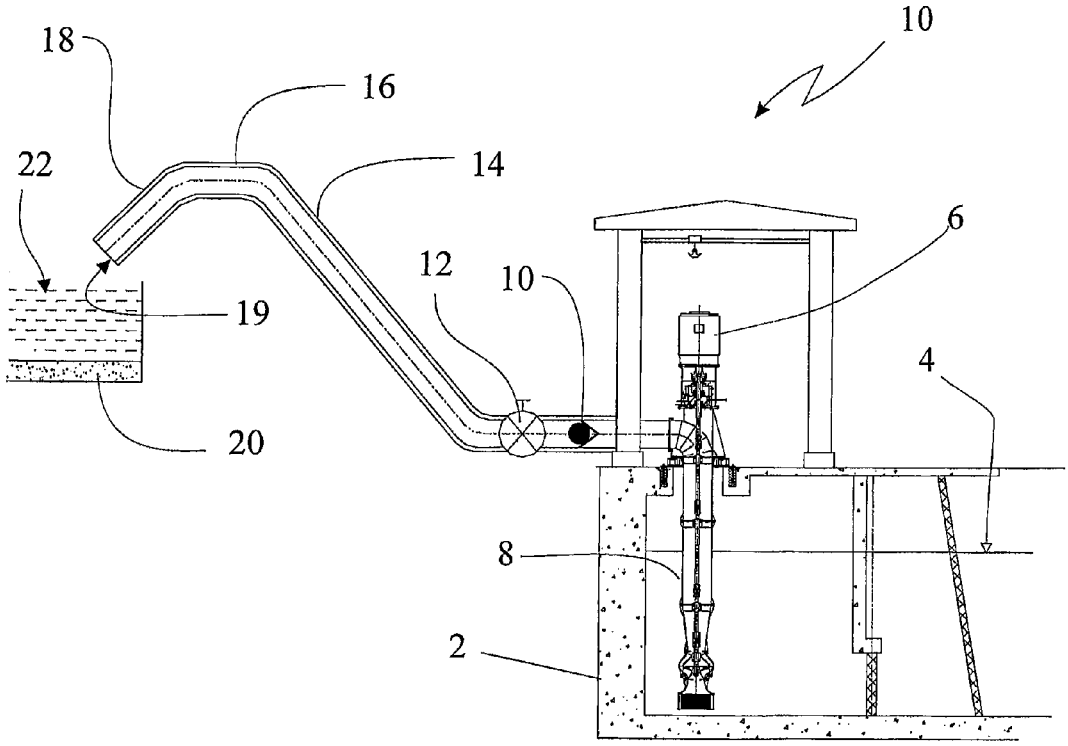
FIG. 1 is a typical layout scheme of conventional pumping system.

FIG. 1 shows a conventional pumping system generally indicated by reference numeral 10 wherein water from a tank (2) at a relatively lower level (4) is pumped to a tank (20) at a relatively higher level (22) by a pump (6) having a suction conduit (8) through delivery conduit having an ascending conduit section (14), a horizontal section (16) and a descending conduit section (18). In this pumping system (10), non return valve (10) and butterfly valves (12) are required to arrest the reverse flow of liquid. Presences of valves (10, 12) create resistance in forward flow of water and result in hydraulic losses and increases pumping cost.

Once the flow is established, the conveying conduits (14, 16 and 18) and the pump casing are filled with water and water form a tank (2) at a relatively lower level is transferred to a tank (20) at a relatively higher level, near the point of consumption. When the pump unit (6) is switched off water contained in the conduits (14, 16 and 18) flows back due to gravity into the lower level tank (2). This flow back establishes a siphon, if the open end (19) of the delivery conduit (18) is below the water level (22) to drain the water from the high level tank (20) back to the low level tank (2).

Figure 2:
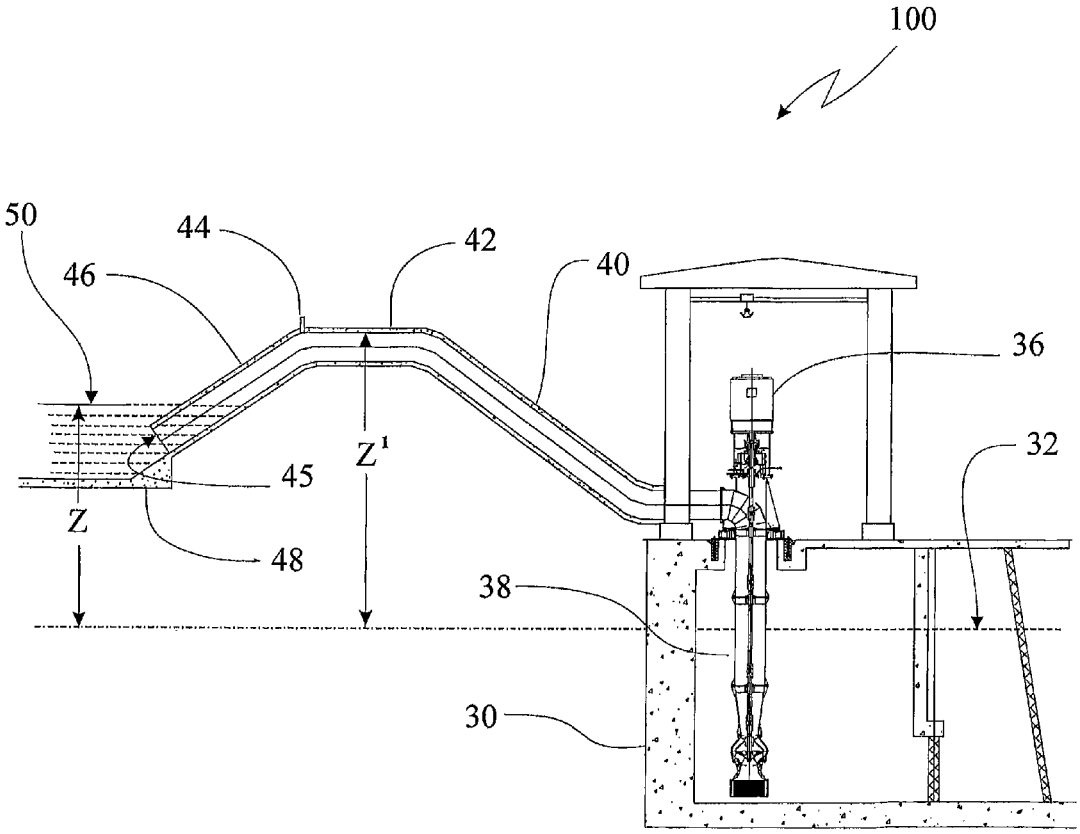
FIG. 2 is a typical layout scheme of the pumping station of this invention.
Figure 4:
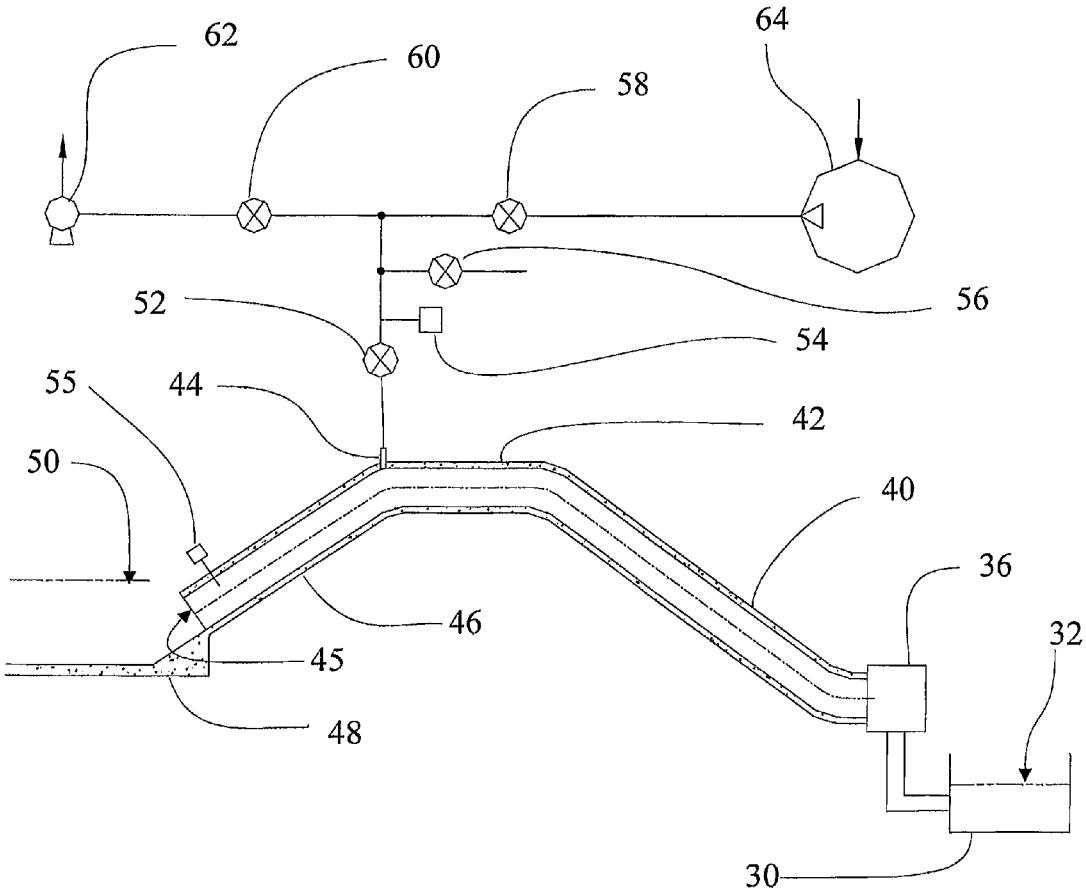
FIG. 4 is a schematic layout of the components of the control system for the pumping system of this invention as shown in FIG. 2.

Referring to FIG. 2, pumping system of this invention is generally indicated by reference numeral 100 wherein water from a tank (30) at a relatively lower level (32) is pumped to a tank (48) at a relatively higher level (50) by a pump (36) having a suction conduit (38) through delivery conduit having an ascending conduit section (40), a horizontal section (42) and a descending conduit section (46). A single port (44) is provided on the horizontal section (42) towards the descending conduit section (46). As shown in FIG. 4 a vacuum pump (62) and an air compressor (64) are connected to the port (44) via solenoid operated valves (58, 60) and motor operated valve (52). An additional solenoid operated valve (54) is provided on the inter connecting pipeline for venting purposes and water level switches (54, 55) are provided as shown to sense water level.

Figure 3:
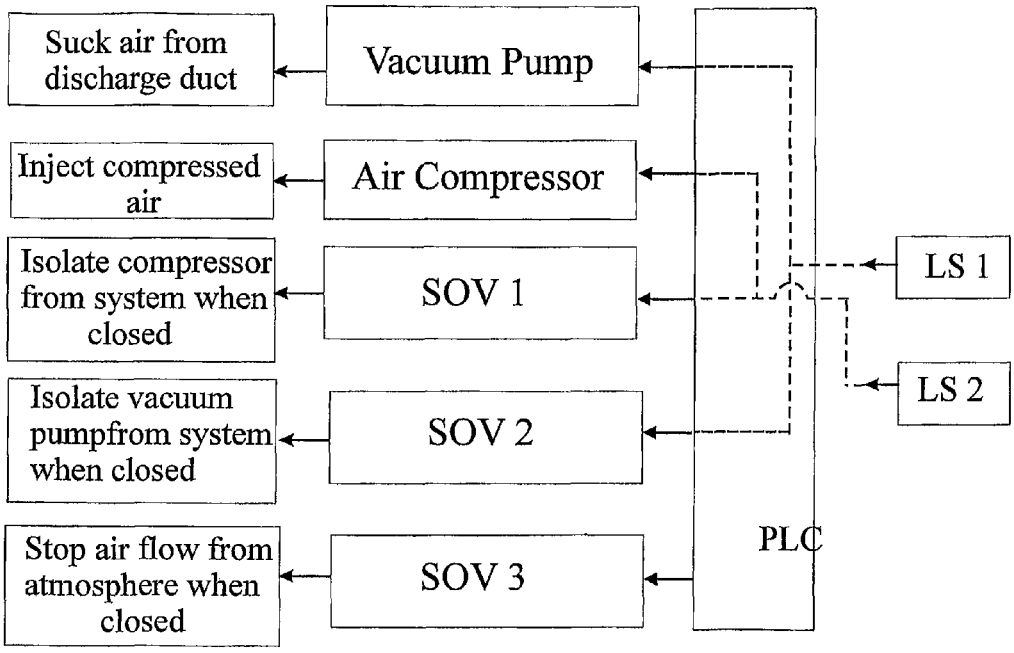
FIG. 3 is the flow chart of the control logic for the pumping system of this invention as shown in FIG. 2.

FIG. 3 is a flow chart depicting the functional interconnection of the programmable logic controller (not specifically numbered) and the components of the control system like vacuum pump (62), air compressor (64), solenoid operated valves (58, 60) and level switches (54, 55).

The siphon system in accordance with this invention operates with reduction in the value of the operating head [$Z^1$–Z (refer FIG. 2)] of the pump (36) by reducing static head leading to energy saving.

The delivery line is configured with a substantially horizontal conduit (42) at the siphon top/peak portion for a short length where the port (44) is located.

Figure 5:
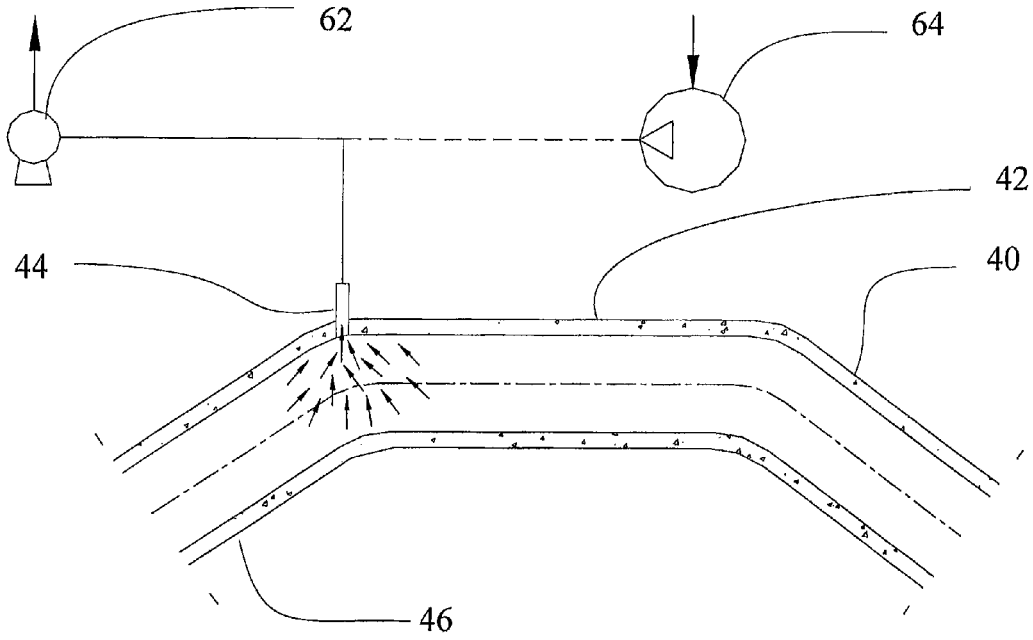
FIG. 5 is an enlarged view of the control port showing evacuation of the pump outlet conduit at the start of pumping operation for the pumping system of this invention as shown in FIG. 2.
Figure 6:
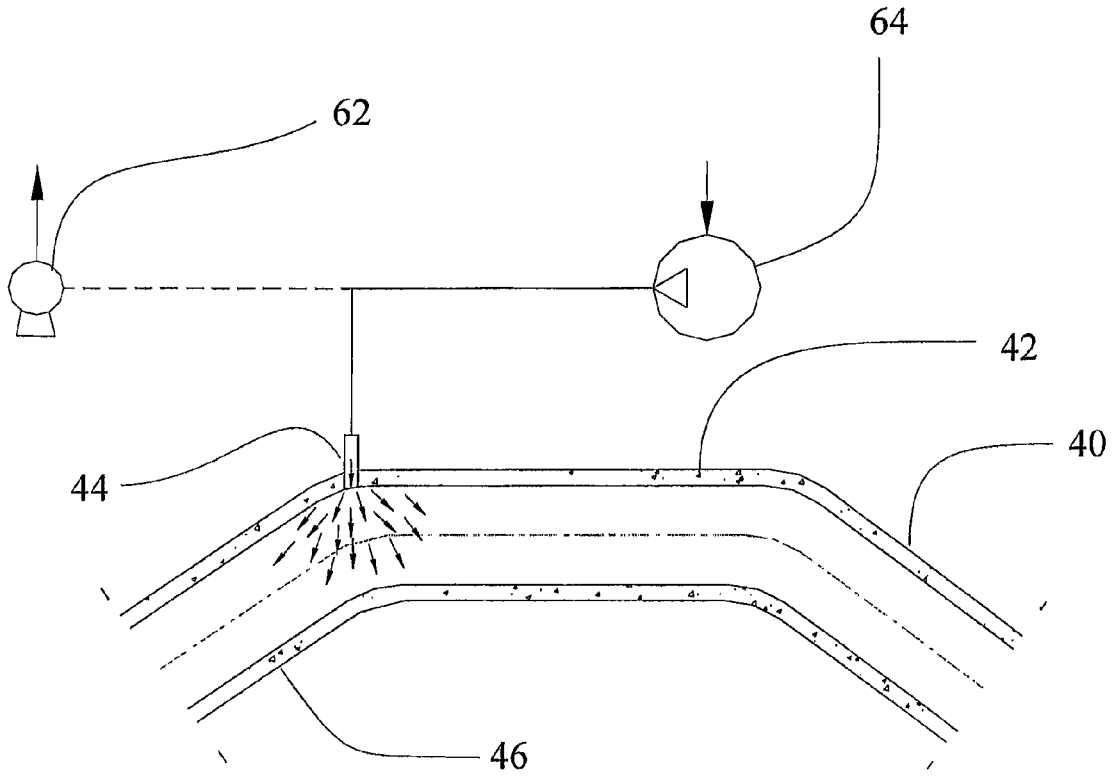
FIG. 6 is an enlarged view of the control port showing air injection of the pump outlet conduit at the end of pumping operation or sudden stoppage of the pump due to power failure, for the pumping system of this invention as shown in FIG. 2.

At the start of pumping operation the motor operated valve 52 and the solenoid operated valve 60 are operated from closed position to open position and the vacuum pump 62 is used to evacuate air trapped in the delivery conduit as shown in FIG. 5. At the end of pumping operation the motor operated valve 52 and the solenoid operated valve 58 are operated from closed position to open position and the air compressor 64 is used to introduce air in the delivery conduit as shown in FIG. 6.

Figure 7:
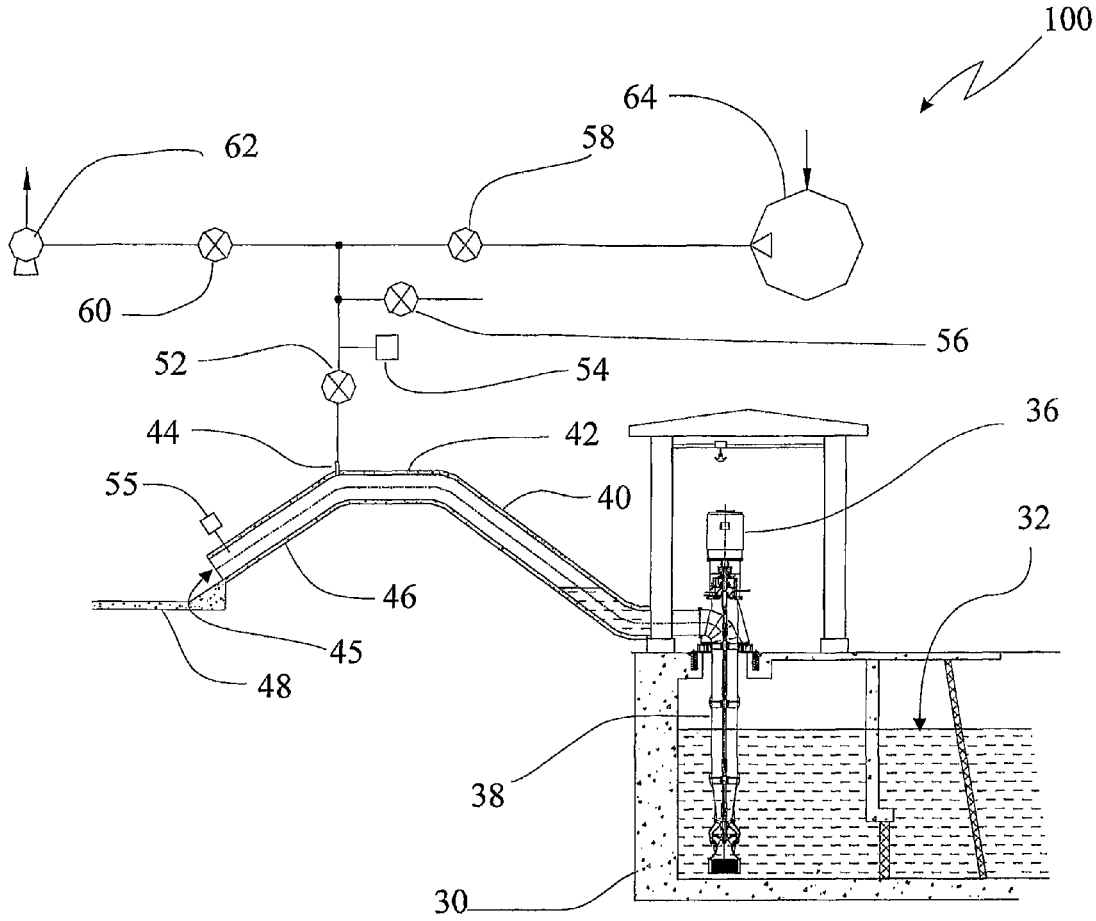
FIG. 7 is a detailed view of the first stage, at the commencement of pumping operation, when the control system has started the vacuum pump operation to evacuate air trapped in the outlet conduit of the pumping system of this invention as shown in FIG. 2.
Figure 8:
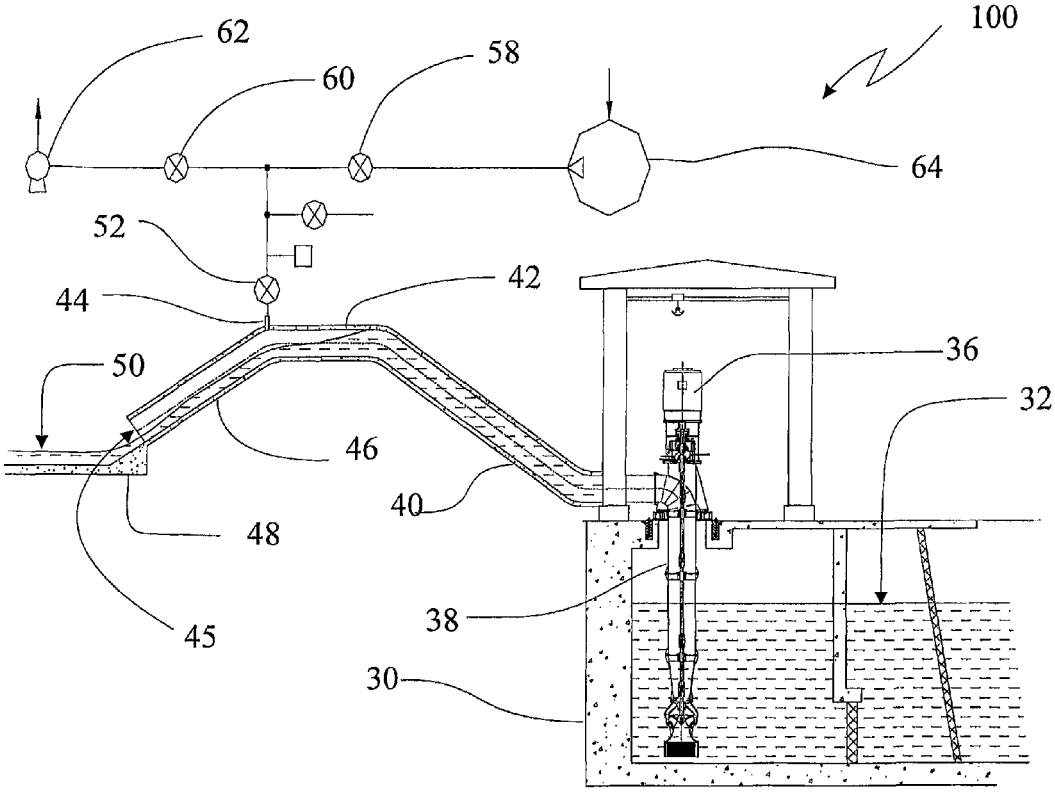
FIGS. 8, 9 and 10 are detailed views of the further stages, showing step by stop evacuation of air trapped in the outlet conduit of the pumping system of this invention as shown in FIG. 2.
Figure 9:
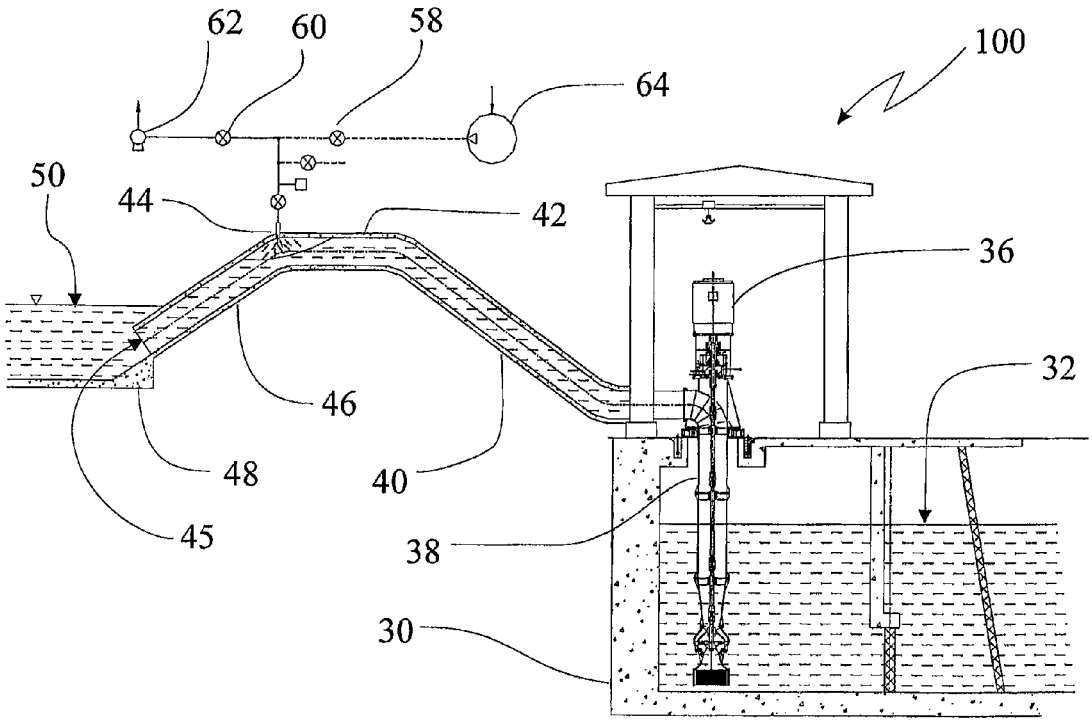

FIGS. 7, 8 and 9 depict various stages in the evacuation process of the delivery conduit at the start of pumping operations.

Figure 10:
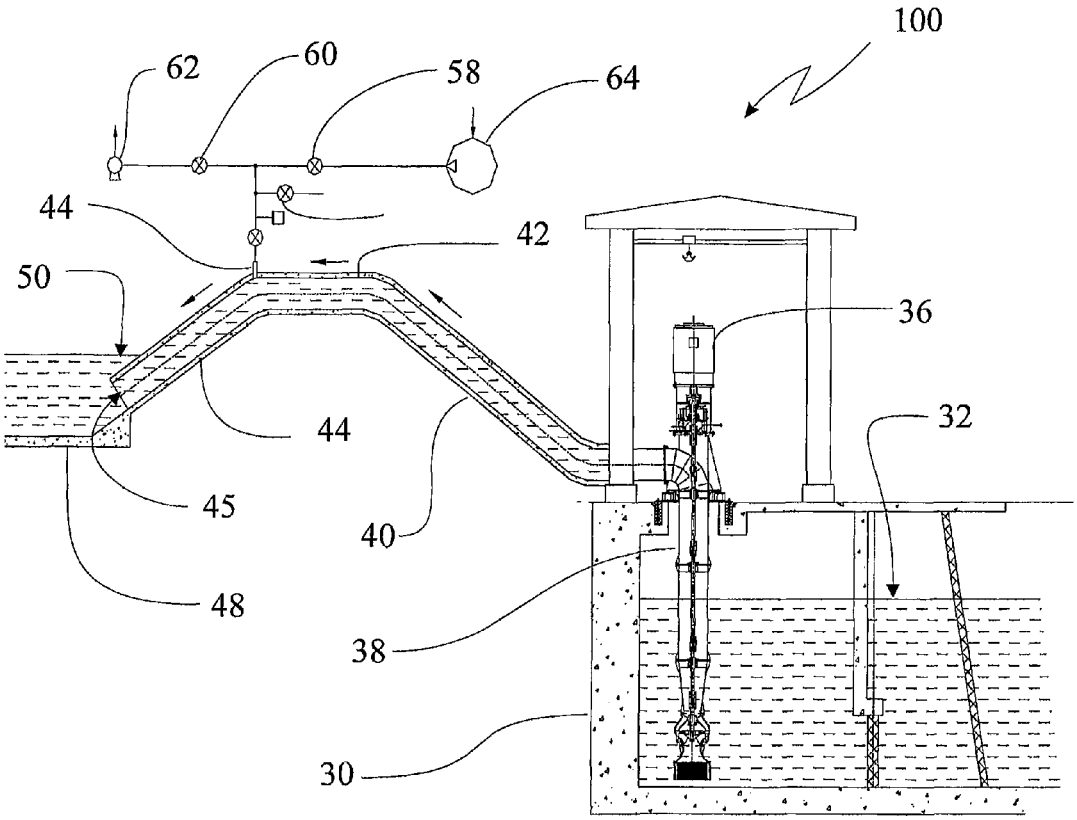
Figure 11:
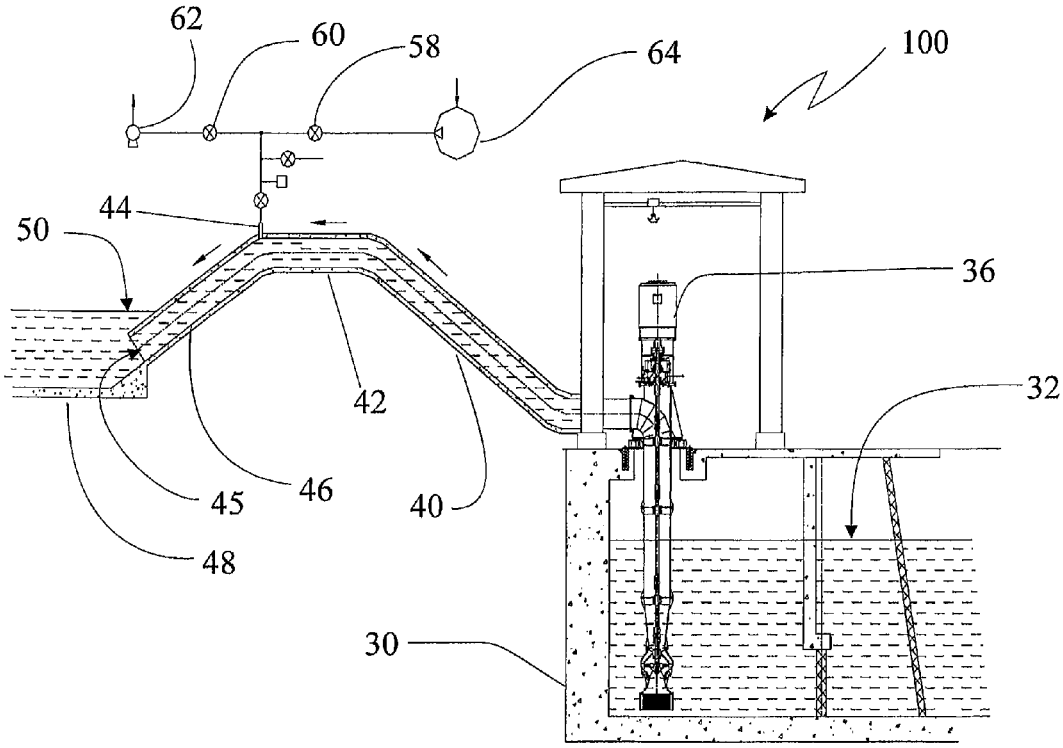
FIG. 11 is a view of the pumping system, when the water is being pumped from a low level to a relatively higher level, of this invention as shown in FIG. 2.
Figure 12:
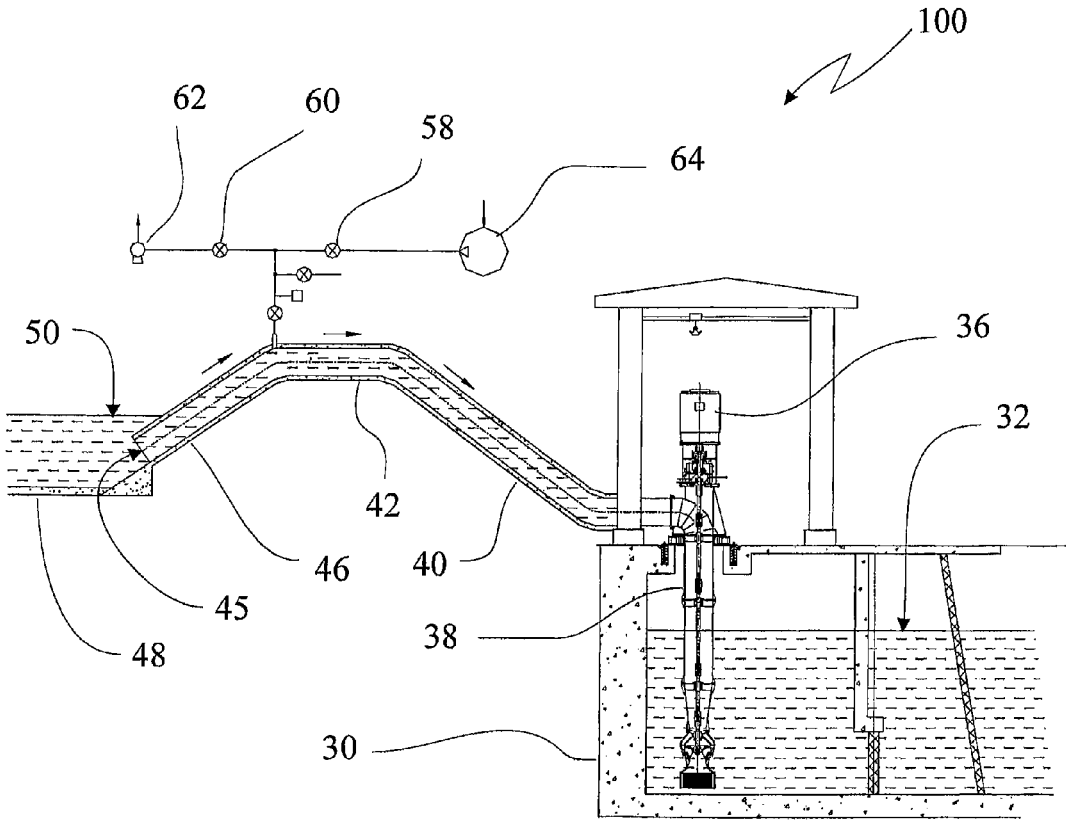
FIG. 12 is a view of the pumping system, when the pump has stopped due to power failure or has been switched off and siphon effect takes place to drain water from the higher level to the lower level, of this invention as shown in FIG. 2.

Referring to FIG. 10, once the delivery conduit (40, 42 and 46) is fully filled with water a steady state operation of pumping water from a tank (30) at a relatively lower level to a tank (48) at a relatively higher level is continued till the required duration or till stoppage of the pump due to power failure.

Figure 13:
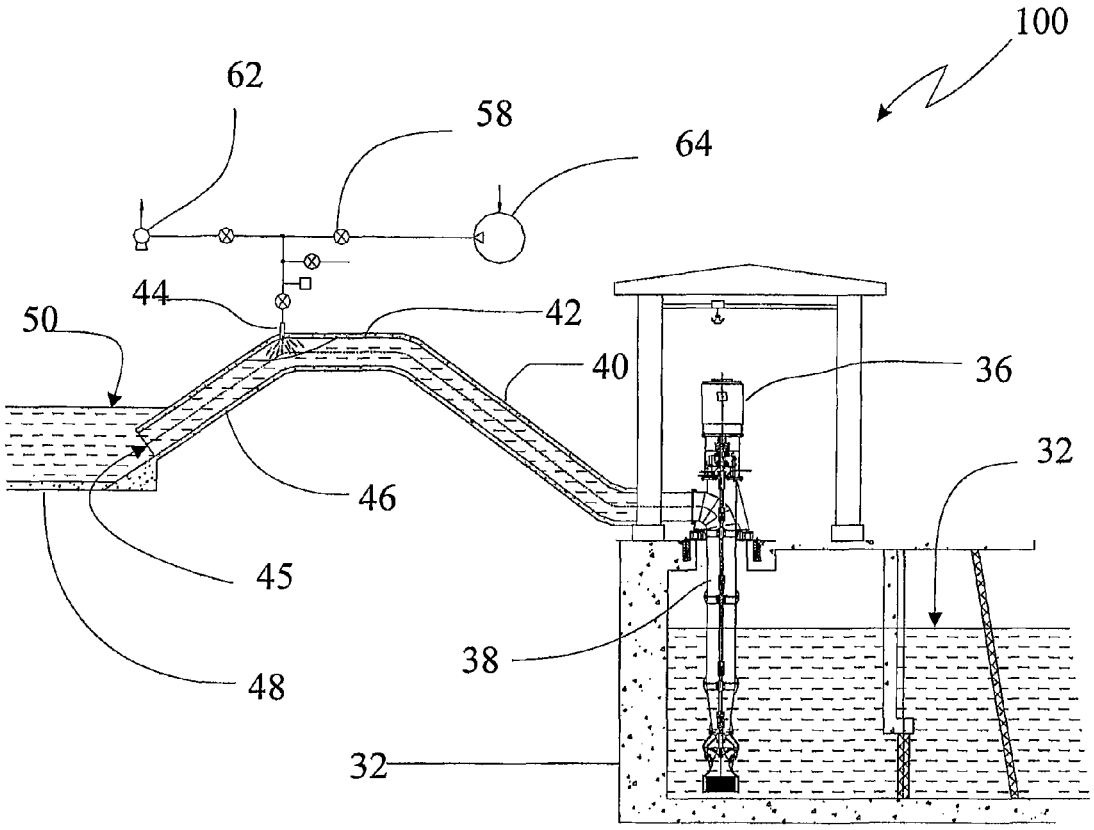
FIG. 13 is a detailed view of the pumping system in a stage, at the end of pumping operation, or when the pump has stopped due to power failure, and the control system has started the air compressor operation to admit compressed air in the outlet conduit of the pumping system, of this invention as shown in FIG. 2.

As soon as the pump 36, is stopped water contained in the ascending delivery conduit section 40 flows back to the low level tank (30), due to gravity initiating a siphon if the free end (45) of delivery conduit section 46 is below the water level (50) of the higher level tank (48). It is necessary to terminate the siphon as otherwise water from the higher level tank (48) will be drained back to the low level tank (30). To prevent the establishment of siphon the motor operated valve 52 and the solenoid operated valve 58 are operated from closed position to open position and the air compressor 64 is used to introduce compressed air into the delivery conduit as shown in FIG. 13.

Figure 14:
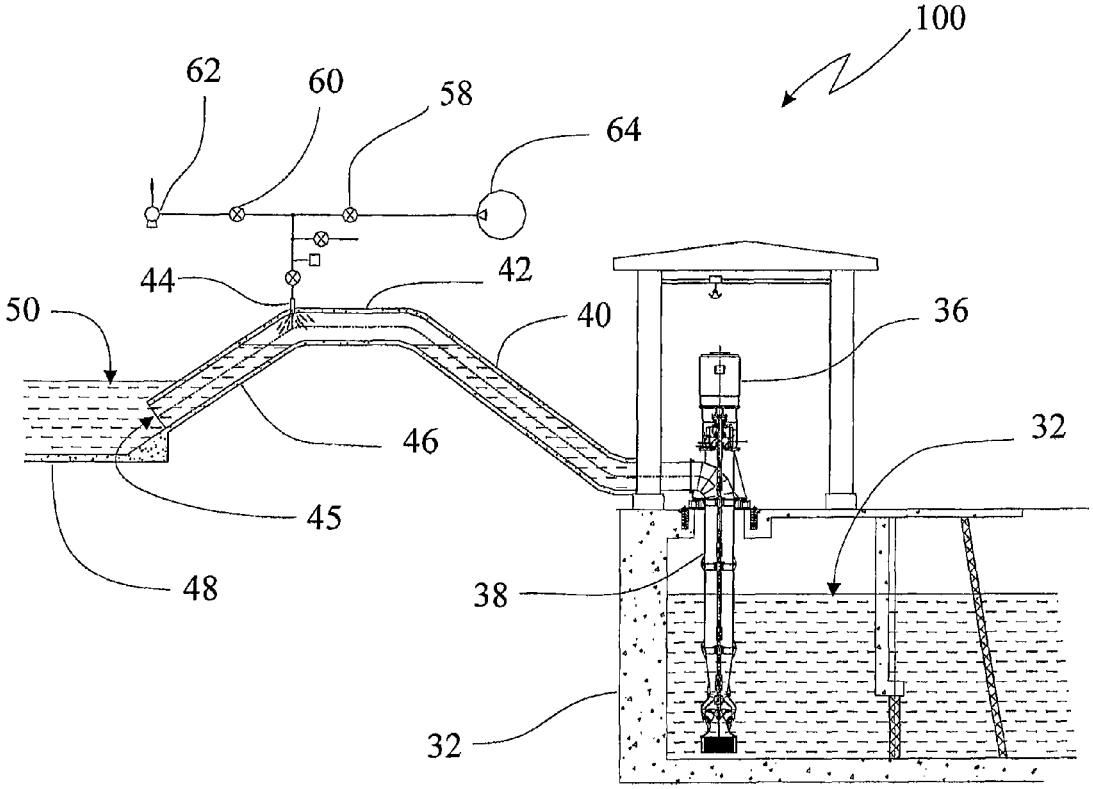
FIG. 14 is a detailed view of the pumping system, wherein more compressed air has been injected into the outlet conduit of the pumping system to break the siphon effect, of this invention as shown in FIG. 2.

A further stage in breaking of the siphon effect is shown in FIG. 14.

Figure 15:
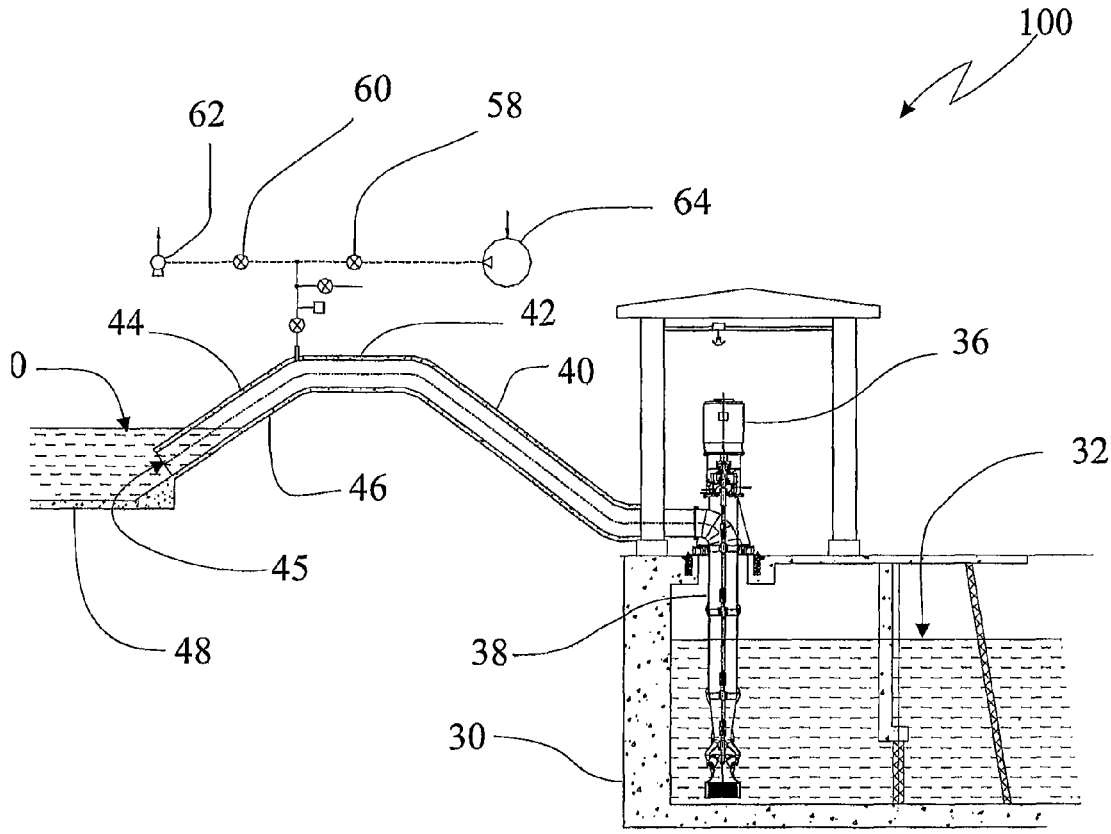
FIG. 15 is a view of the pumping system, at the end of the pumping operation of this invention as, shown in FIG. 2.

FIG. 15 depicts the pumping system at the end of the pumping operation.

Figure 16:
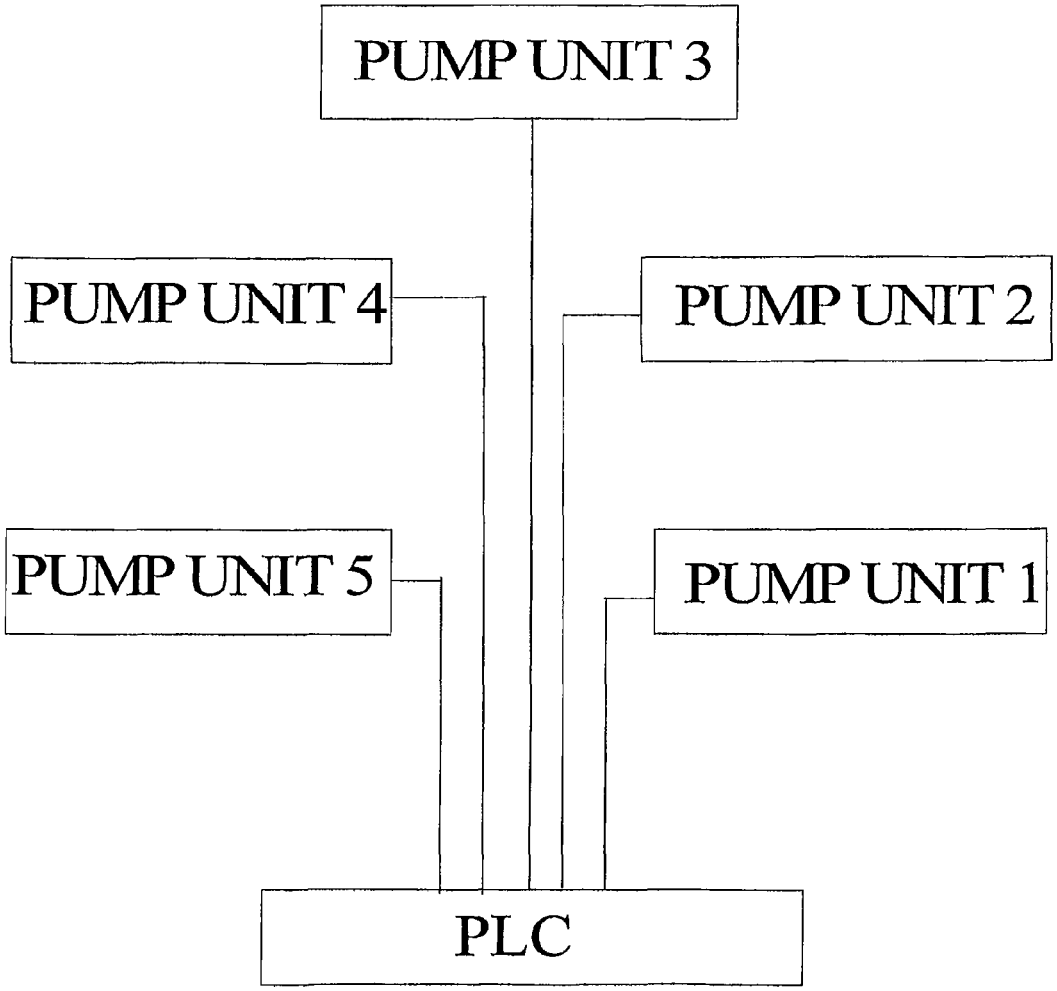
FIG. 16 is a schematic layout of the control system for controlling multi pump configuration in a pump house.

FIG. 16 indicates the inter connection of the controller in case of multiple pumps installed in a pumping station.

The length of the flat section at the peak of the delivery conduit is typically at least 3 to 5 times the diameter of the delivery conduit.

It is also possible to optimize siphon head that can be achieved based on the geographical location of installation of the pumping system i.e. altitude above mean sea level and also the water temperature since they affect the atmospheric pressure and the vapour pressure of water which influence the siphon system.

While considerable emphasis has been placed herein on the specific components of the preferred system, it will be appreciated that many changes can be made in the preferred embodiment without departing from the principles of the invention. These and other changes in the preferred components of the invention will be apparent to those skilled in the art from the disclosure herein, whereby it is to be distinctly understood that the foregoing descriptive matter is to be interpreted merely as illustrative of the invention and not as a limitation.

The invention claimed is:

1. A pumping system for pumping liquid from a lower level to an operatively higher level; said pumping system comprising: (i) a pumping device fitted at the lower level; (ii) a bent delivery conduit; said bent delivery conduit having an operatively inclined ascending conduit section; an operatively inclined descending conduit section and an operatively horizontal peak section between said inclined sections; one end of said ascending conduit fitted to an outlet of said pumping device and one end of said descending conduit being below a liquid level of said higher level; a junction being defined between said horizontal peak section and said descending conduit section; (iii) a single port opening provided at the junction between said horizontal peak section and said descending conduit section, and spaced apart from said ascending conduit section; and (iv) control means adapted to introduce pressurized air into and evacuate air from said delivery conduit through said single port opening.

2. A pumping system for pumping water as claimed in claim 1, wherein said control means comprises a vacuum pump, an air compressor, solenoid operated valves, a motor operated valve, level switches and a programmable controller.

3. A pumping system for pumping water as claimed in claim 1, wherein the angle of inclination of said inclined conduits is in the range of 40 to 45 degrees with reference to a normal to the horizontal peak section.

4. A pumping system for pumping water as claimed in claim 1, wherein said control means is provided with a power backup unit in the event of power failure.

5. A method of pumping liquid from a lower level to an operatively higher level, said method comprising the steps of: (a) providing a pumping device fitted at the lower level; (b) providing a bent delivery conduit having an operatively inclined ascending conduit section, an operatively inclined descending conduit section and an operatively horizontal peak section between the inclined sections; fitting one end of the ascending conduit section to an outlet of the pumping device and having an open end of the descending conduit dipped below a liquid level of said higher level; (c) providing a single port opening at a junction defined between the horizontal peak section and the descending conduit section, spaced apart from said ascending conduit section; (d) providing control means to introduce pressurized air into and evacuate air from the delivery conduit through the port opening; (e) providing a standby power backup system for supplying electrical power to the control means; (f) pumping liquid from the lower level to the operatively higher level via the delivery conduit; (g) evacuating an air pocket which forms in the delivery conduit, via the single port opening to reduce a siphonic head difference between the liquid at the lower level and higher level; and (h) in case of failure of a power supply to the pumping device or at an end of a pumping cycle, breaking a reverse flow of water from the higher level to the lower level due to siphon action by admitting compressed air via said single port opening.

* * * * *